United States Patent [19]

Herkness, II

[11] Patent Number: 4,498,547

[45] Date of Patent: Feb. 12, 1985

[54] EARTH SOIL SAMPLER

[76] Inventor: Wayne Herkness, II, Box 511, Lewisburg, W. Va. 24901

[21] Appl. No.: 564,503

[22] Filed: Dec. 22, 1983

[51] Int. Cl.[3] ..... E21B 25/02

[52] U.S. Cl. ..... 175/244; 175/20; 73/864.44

[58] Field of Search ..... 175/244, 19, 20, 49, 175/403, 58; 73/864.51, 864.44, 864.45; 166/264, 162

[56] References Cited

U.S. PATENT DOCUMENTS

| | | | |
|---|---|---|---|
| 2,666,330 | 1/1954 | McAndrew | 73/864.44 |
| 3,367,188 | 2/1968 | Robinson | 175/20 |
| 4,359,110 | 11/1982 | Peterson | 175/20 |

*Primary Examiner*—James A. Leppink
*Assistant Examiner*—Thuy M. Bui
*Attorney, Agent, or Firm*—John Gibson Semmes

[57] ABSTRACT

A portable and collapsible hand tool is disclosed wherein successive small samples of suspected contaminated earth soil may be directly deposited in a sampler bottle, following selective penetrations and extractions of the soil. The sampler is characterized by a substantial balanced mass which is vertically disposed above the sampler tool head, the head having in extension thereof a soil probe column which forms a tube of reverse draft, the same being interconnected to an inverted sampler bottle which is retained within the head where it is shock protected.

8 Claims, 3 Drawing Figures

EARTH SOIL SAMPLER

BACKGROUND OF THE INVENTION

1. Field of the Invention

This earth soil sampler is specifically adapted to extract and contain successive samples of earth soil such as may have been contaminated by oil spillage. For example, earth soil in a given ten foot square vicinity of transformers, may be contaminated by oil containing PCB and if this likelihood occurs, it is desirable to secure small samples which cumulatively comprise a 5 gram total. This total, in practice, comprises 10 or more probing extractions and is desirably deposited in a 20 ml glass container for testing.

2. Description of the Prior Art

Numerous means have been created to obtain small earth samplings For example, operators have secured a sampler tube in extension of a rod. In this method the operator would hold the rod and while walking over the ground, probe with the tube end numerous times to obtain a cumulative sample. The resultant disadvantageous gravitational effect of packing the tube precludes successive sampling of minute aliquots in a given operation. Furthermore, such samples as were obtained in this manner became difficult to remove. This development had evolved from the classic mode of obtaining samples through the use of a spoon or small trowel wherein plural samples were scraped from the surface of the suspected contaminated soil in a 10 foot square or more area. In this earlier method, the operator desirably estimated his individual samplings to be at approximately 0.5 grams each and in digging over a given area, he would secure upwards of 10–12 samples, adding each to the contents of the same sample bottle. Not only in the art was it difficult for the operator to thus follow a definite pattern such as will insure a relatively complete coverage, but also it was difficult to obtain properly representative examples using such procedures. It was moreover difficult for operators to produce consistently sized sub-samples.

Other known prior art is present in such devices as may be used for aerating turf. There are also certain pertinent soil testing and coring devices. The best known aerators are represented by Schell et al U.S. Pat. No. 3,163,456 and Jones Pat. No. 522,286 (British) as well as Broadbent Pat. No. 856,537 (British). In none of this art, is the problem addressed of securing minute successive samples for instantaneous containment in a frangible glass bottle, the contents of which are sequentially adapted to testing. The inexact art or aerating thus does not address the more exact problem of soil sampling such as is addressed by the present invention. Coring devices are represented by U.S. Pat. No. 1,109,446 to Melberg and U.S. Pat. No. 2,666,330 to McAndrew. In the Melberg patent a so-called soil magazine is incorporated into the interior of a lightweight shaft for the purpose of obtaining a given soil sample. No effort is made to restrict the in-feed for a given sample nor to effectively cushion the soil magazine against fracture, considering the relative mass of the shaft, as in the present invention. The McAndrew coring device while including a container within, makes no provisions for the controlled obtaining of minute samples in a frangible container such as in the present invention.

SUMMARY OF THE INVENTION

Where a spill of transformer oil has occurred, and it is suspected of containing PCB, it is necessary to test the soil on which the oil has spilled to determine if any such contamination is present in the soil. In certain test methods that are in standard use to detect and quantify the presence of PCB in the soil, a 5 gram sample is supplied. The standard testing procedure requires that this 5 gram sample should not be taken in one spot alone, but should be drawn from 10–12 different places in the area which is to be evaluated for contamination. Each of the specific aliquots should be approximately the same size and of such a size that the 10–12 together total approximately 5 grams.

To probe and secure such minute samples, viz. less than a gram each, the present device has been created whereby a rod of very substantial mass, relative to the overall unit, secures a sample head or retainer housing at its lower end. The retainer housing mounts a head or probe at its lowermost extension, such that the probe communicates with the interior of an inverted glass bottle, the bottle being held inside the retainer against shock and breakage. The bottle is appropriately cushioned at its throat and bottom against such shock as may occur upon exercising the sampling stroke. The bottle is compressibly retained for facile mounting and removal by an unique sustension means within the retainer housing. The probe itself is in effect, an extension of the retainer housing and comprises a small column of reverse draft from top to bottom and includes an external depth limiting column intermediate ends thereof.

DESCRIPTION OF PREFERRED EMBODIMENTS

Figure 1:
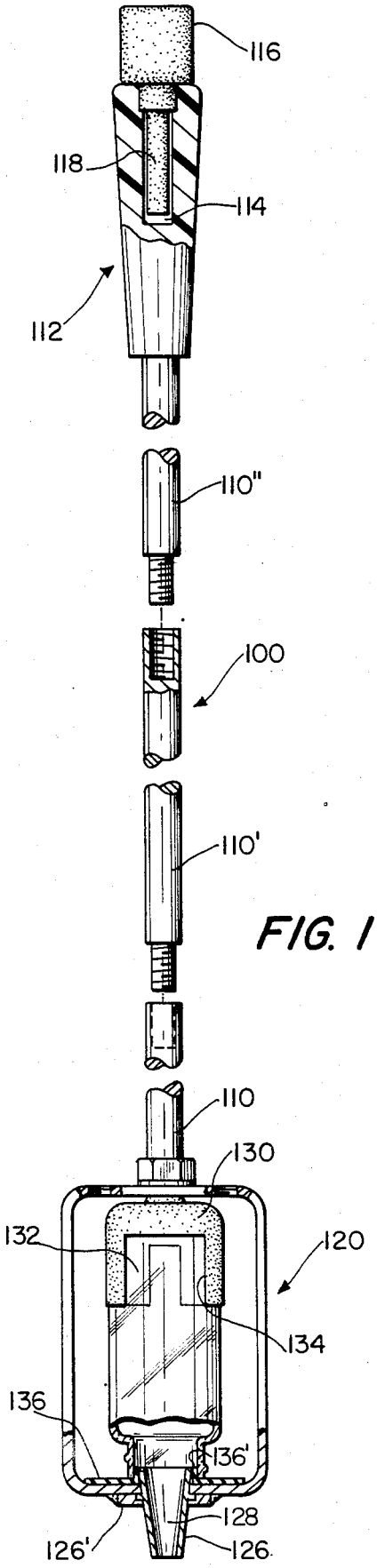
FIG. 1 shows an earth soil sampler of the invention.
Figure 2:
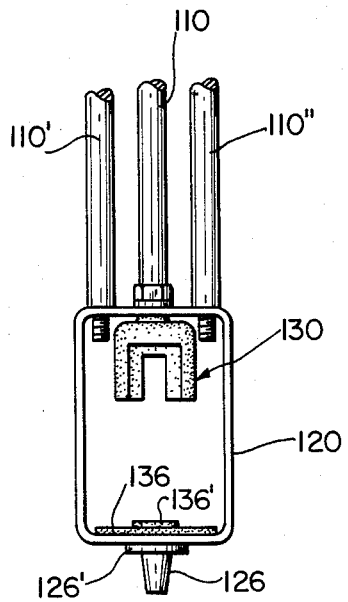
FIG. 2 shows a part of the invention without the removable sampler bottle.
Figure 3:
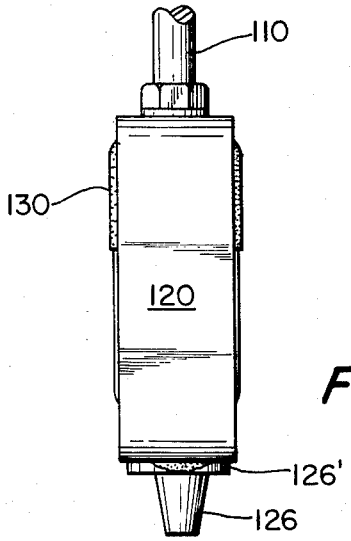
FIG. 3 shows a side view of FIG. 2.

The earth soil sampler is generally designated by the numerical 100, the same comprising three principal components, namely: the shaft, 110; the sampler bottle container structure 120 with probe and the bottle retention means, 130. The bottle retention means comprises in part an upper plastic collar which is of lesser diameter than the outer diameter of the base of the bottle.

The structure is designed in assembled form to comprise a substantial mass, relative to the lightweight frangible sample bottle. Shaft 110 is preferably formed of three connected rod sections, each of which is preferably made of solid stainless steel, the sections 110', 110'' and 110''', each having corresponding screw and screw thread interconnection; the topmost shaft section 110''' threadedly securing a handle 112. Handle 112 is centrally bored atop to form cavity 114 for seating by friction-fit a polyethylene pusher piece 116, which has a projection 118. Upon removal from the handle, projection 118 is adapted to forcible entry into the corresponding soil penetrating columnar area 128 of the probe 126, as will be more fully explained hereinafter. The lowermost section 110' of the shaft has semi-permanent connection with the bottle containing head 120, the top of said head having at least three aligned bores therein. The central-most bore secures the lowermost section of the shaft 110 and the two laterally disposed bores of the head seat other portions 110'' and 110''' of the shaft so that the unit may be disassembled and thus formed into a compact, portable unit.

The head 120 at its bottom contains another bore in the central portion thereof, which said bore firmly seats the probe 126 therein. This bore is aligned with the overhead central bore which secures the lowermost section of the shaft. Probe 126 defines intermediate ends thereof the flange 126', this flange serving to limit penetration of the probe and to reinforce the lowermost portion of the head as against deformation. Probe 126 defines interiorly thereof, a divergent column 128, which extends in reverse draft upwardly into the head 120 a sufficient distance to enter the throat of a seated, removeable sampler bottle. As indicated in the drawings, the bottle retention means comprises the plastic collar 130 which by design has a bottle removing cutout 134 and corresponding expansion cutout 132.

An example of a specific sample collecting device, made in accordance with the invention, comprises the following detailed construction. To the end of a sectional rod of stainless steel, a steel housing was affixed. The housing was adapted to hold a 20 ml capless bottle in the inverted position. Bottle securing means within the housing provided a soft plastic cushion in two parts which compresses against both ends of the inverted bottle, to seal it. The housing itself comprised an essentially upright rectangular frame 2"×3"×⅛41 wall, which is open on two sides. To the lower end of the housing the probe tube is attached for infeed connection to the bottle.

This probe tube with an ID of 5/16 to ⅜ inch at the lower end and tapered out to increase the diameter away from the bottom end with a 5–10 degree reverse draft. This tube is approximately 1 inch long with a wall thickness of 50–60 thousandths inch, the top end thereof extending into the open mouth of the sample opening ⅛ to ¼ inch. The sample bottle rests on a soft plastic pad within the interior of the housing surrounding the tube as for example, a pad with an O ring or collar washer the size of the bottle throat and the top of the tube being compressibly held against the pad by a soft expansible plastic collar. When the tube is pushed into the ground, the depth it will penetrate is limited by an external fixed flange secured around the tube on the exterior of the housing to about ½ to ¾ inch concentrically.

In use, the tube comprising the probe is pushed into the ground. The earth soil plug entering the tube does not bind against the wall of the tube because the reverse draft thereof opens the diameter. When the probe is pushed into the ground again, the soil previously obtained in the tapered probing tube pushes on up the tube of the probe and ultimately into the sample bottle. When a dozen probes into the ground have been made, the device is inverted, which rights the bottle. A pusher rod forming the topmost part of the handle, being ¼ inch in diameter and a few inches long is used to push the soil still in the tube, into the bottle.

Upon completion of this procedure, the operator pushes the bottle inwardly against the plastic collar retainer and out through the side opening of the retainer.

I claim:

1. An earth soil sampler for the probing extraction and containment of multiple samples of soil, comprising:

(A) a rigid shaft which is of substantial mass, relative to the overall sampler;

(B) an elongated bottle retainer secured to one end of the shaft, said retainer mounting ($B_1$) shock-resistant bottle securing means intermediate ends of the retainer and ($B_2$) a hollow probe in extension of the lower end of the retainer, said probe having interconnection with the retainer interior of the retainer;

(C) a removable sampler bottle held in shock-resistant inverted containment by the retainer and in coactive in-feed relationship to the hollow probe.

2. The earth soil sampler according to claim 1 wherein the bottle securing means comprises an expansible collar secured inside the top of the retainer to engage by compression the bottom portion of the inverted bottle and a pad with circular projection mounted to the bottom interior of the retainer to engage the bottle mouth and throat interior, thus aligning the bottle in sealed relationship to the hollow probe.

3. The earth soil sampler according to claim 2, wherein the hollow probe defines an interior column of reverse draft, the upper annulus of the probe being of increased diameter relative to the lower annulus.

4. The earth soil sampler according to claim 3, wherein the rigid shaft comprises plural sections, each of which may be removably joined to another, and wherein means in the retainer secure the respective sections for portability of the disassembled sampler.

5. The earth soil sampler according to claim 2, wherein the rigid shaft comprises plural sections, each of which may be removably joined to another, and wherein means in the retainer secure the respective sections for portability of the disassembled sampler.

6. The earth soil sampler according to claim 1 wherein the hollow probe defines an interior column of reverse draft, the upper annulus of the probe being of increased diameter relative to the lower annulus.

7. The earth soil sampler according to claim 6, wherein the rigid shaft comprises plural sections, each of which may be removably joined to another, and wherein means in the retainer secure the respective sections for portability of the disassembled sampler.

8. The earth soil sampler according to claim 1, wherein the rigid shaft comprises plural sections, each of which may be removably joined to another, and wherein means in the retainer secure the respective sections for portability of the disassembled sampler.

* * * * *